US008209778B2

(12) United States Patent
Matsumoto

(10) Patent No.: US 8,209,778 B2
(45) Date of Patent: Jul. 3, 2012

(54) HEADGEAR

(75) Inventor: Kimio Matsumoto, Higashiosaka (JP)

(73) Assignee: Yamamoto Kogaku Co., Ltd., Osaka (JP)

( * ) Notice: Subject to any disclaimer, the term of this patent is extended or adjusted under 35 U.S.C. 154(b) by 0 days.

(21) Appl. No.: 11/251,042

(22) Filed: Oct. 14, 2005

(65) Prior Publication Data

US 2006/0117450 A1 Jun. 8, 2006

(30) Foreign Application Priority Data

Dec. 7, 2004 (JP) ..... 2004-354611

(51) Int. Cl.
*A42B 1/24* (2006.01)

(52) U.S. Cl. ..... 2/209.13; 2/452; 2/425; 2/6.3; 2/68

(58) Field of Classification Search ..... 2/209.13, 2/195.1, 175.1, 452, 173, 205, 206, 10, 68, 2/200.2, 209.3, 209.4, 425, 6.3, 209.14; 351/155
See application file for complete search history.

(56) References Cited

U.S. PATENT DOCUMENTS

| | | | | |
|---|---|---|---|---|
| 2,705,802 | A * | 4/1955 | Tellier | 2/68 |
| 4,279,039 | A * | 7/1981 | Drew | 2/428 |
| 4,918,753 | A | 4/1990 | Mermillod | |
| 5,617,589 | A * | 4/1997 | Lacore et al. | 2/452 |
| 5,855,026 | A * | 1/1999 | Viola | 2/428 |
| 6,085,359 | A * | 7/2000 | Viola | 2/428 |
| 6,644,807 | B1 * | 11/2003 | Hood | 351/155 |
| 6,647,554 | B1 * | 11/2003 | Yan | 2/209.13 |
| 6,671,885 | B2 * | 1/2004 | Viggiano | 2/209.13 |
| 6,792,619 | B1 * | 9/2004 | Morris et al. | 2/10 |
| 2003/0233702 | A1 * | 12/2003 | Chen | 2/428 |

FOREIGN PATENT DOCUMENTS

| | | |
|---|---|---|
| JP | 56-34825 | 4/1981 |
| JP | S61-177624 | 11/1986 |
| JP | 3-7851 | 1/1991 |
| JP | H3-7851 | 1/1991 |
| JP | 3013446 | 7/1995 |

* cited by examiner

*Primary Examiner* — Alissa Tompkins
(74) *Attorney, Agent, or Firm* — DLA Piper LLP (US)

(57) ABSTRACT

The headgear of the present invention includes a headcover with a headcover attaching part on right and left sides of the headcover, wherein a goggle attaching part provided at a back side of an end portion of a belt of a goggle is detachably attached to the headcover attaching part so that the goggle can be attached to the headcover. The goggle of the present invention includes a goggle attaching part at a back side of an end portion of a belt, wherein the goggle attaching part is detachably attached to a headcover attaching part provided at right and left sides of the headcover so that the goggle can be attached to the headcover of the headgear.

11 Claims, 9 Drawing Sheets

HEADGEAR

BACKGROUND OF THE INVENTION

1. Field of the Invention

The present invention relates to a headgear including a headcover and a pair of goggles that are suitable for wearing in sports such as swimming and skiing.

2. Description of the Related Art

As an example of conventional goggles, a swimming goggle includes a main body of the goggle and an elastic belt such as a rubber provided at right and left sides of the main body. To wear the goggle, a user has to expand the belt and cover his or her head with it over a swimming cap so as to fasten the belt around the circumference of the head.

In addition, as this kind of a headgear, for example, as shown in FIG. 7, there is a swimming cap with a water glass. In this swimming cap with a water glass, an extensible swimming cap main body 11 and a water glass 13 are connected each other via an extensible belt 12 at the both sides of the main body 11. Then, the extensible belt 12 of the water glass 13 may be provided with additional parts for adjusting the extension of the belt separately other than the case that the extension depends on the belt itself (Japanese utility model application laid-open (Kokai) S56-34825).

Further, as this kind of a headgear, for example, as shown in FIG. 8, there is a swimming cap with goggles. This swimming cap with goggles includes a goggle main body 21, a pair of belts 22 provided at a base end portion of the goggle main body 21, a swimming cap 23 and a pair of holding assemblies 24 located at the right and left sides of the swimming cap 23 to hold one end of the belts 22 detachably. Further, as shown in FIG. 9, the holding assembly 24 is configured by a stopping portion 25 for stopping the one end of the belts 22 and a fixing ring 26 with a circle cross section for fixing this stopping portion 25 to the swimming cap 23 (Japanese utility model application laid-open (Kokai) H03-7851).

However, the above-described conventional goggle and headcover have the following problems.

At first, in the above-described conventional swimming goggle, if the fastening position of the belt is deviated upward, the swimming cap also tends to deviate upward or forward, so that the swimming cap may easily drop off.

Furthermore, the above-described conventional swimming goggle is difficult to wear for a person who has a disability in his or her hand or for a young child. In other words, it is difficult for the young child to wear because a neck of the young child is very weak and when the young child tries to wear it by himself or herself or when other person tries to make the young child to wear it, his or her neck swings by the excessive force. For the person who has a disability in his or her hand, wearing the conventional type of swimming goggle could be difficult because he or she has to hold and pull the belt strongly by his or her hand to wear it.

In addition, the above-described conventional swimming goggle may be provided with additional parts for adjusting the extension of the belt (a holding force adjusting mechanism), however, when adjusting the length of the belt, the user has to take off the goggle first and adjust the length of the belt, and then, put the goggle back again. Therefore, in order to improve the fitting comfortability, the operation to take off and wear it is troublesome and inconvenient.

Further, since the above-described conventional swimming goggle is configured so as to fasten the belt around the entire circumference of the head, if the belt is fastened tightly to prevent the goggle from dropping off, the user's head is compressed by the belt in a long time wearing and the user may feel a headache.

In the next place, according to the swimming cap with a water glass described in the Japanese utility model application laid-open (Kokai) S56-34825, since the swimming cap main body 1 land a water glass 13 are connected each other via the extensible belt 12, the wager glass 13 does not easily drop off, however, the swimming cap main body 11 has to have a special shape and this type of swimming cap may not be always suitable for normal swimming use. Because wearing the water glass 13 is not always necessary just for swimming, the user sometimes has to detach the water glass 13 from the swimming cap when it is not needed or the user sometimes has to attach the water glass 13 back to the swimming cap when it is needed, and this detach/attach operation is not convenient for the user. Further, when the user takes off the water glass 13, the belt partially remains at the swimming cap main body 11 and this is very troublesome.

In addition, according to the swimming cap with the goggle described in the above-described Japanese utility model application laid-open (Kokai) H03-7851, the user may jam his or her hair in the holding assembly 24 when attaching the goggle main body 21 to the swimming cap 23 by the holding assembly 24 once after wearing the swimming cap 23. Further, in this case, since the user handles the holding assembly 24 while expanding the swimming cap 23, the swimming cap 23 may be deviated from his or her head or the swimming cap 23 itself may get damaged. In addition, in case of attaching the goggle main body 21 to the swimming cap 23 by the holding assembly 24 in advance before wearing the swimming cap 23, the user cannot get good fitting comfortability of the goggle when he or she wears the swimming cap 23, and further, this may cause water leak into the goggle.

BRIEF SUMMARY OF THE INVENTION

The present invention is made in order to solve the above noted problems. An object of the present invention is to provide a headgear which, includes a headcover when it is used together with the goggle that is specially configured, does not easily drop off from a user's head, and can be easily fit by himself or herself, or by another person. Yet another object of the present invention is to provide a goggle, of which holding force can be easily associated with the user's desired strength and fit when it is used together with the headcover that is specially configured.

Thus, a headgear according to the present invention may include a headcover attaching part on a front side (outer surface) of the headcover, wherein a goggle attaching part which is provided at a back side of an end portion of a belt of a goggle is detachably attached to the headcover attaching part so that the goggle can be attached to the headcover.

Further, a goggle according to the present invention may include a goggle attaching part at a back side of an end portion of a belt, wherein the goggle attaching part is detachably attached to a headcover attaching part provided at a front side of a headcover so that the goggle can be attached to the headcover.

Moreover, the headcover and the belt may have flexibility.

Further, it is also possible that the headcover attaching part is provided with many loops and the goggle attaching part is provided with many hooks.

In addition, the headcover attaching part may be provided at the whole area or only the both sides of the headcover.

Further, the headcover attaching part may be provided on the approximate center portions of the approximate lower half portions of the both sides of the headcover so that the headcover attaching part has an occupied area that is about 25% and more of the superficial area of the user's head.

In addition, a finger grip portion may be provided to the far end portion of the belt.

With the above structure, the headcover according the present invention does not easily drop off from a user's head, can be easily fit by himself or herself, or by another person when it is used together with the goggle of the present invention.

Further, with the goggle according to the present invention, holding force of the goggle can be easily associated with the user's desired strength and fit when it is used in the headgear of the present invention.

DESCRIPTION OF THE PREFERRED EMBODIMENTS

Figure 1:
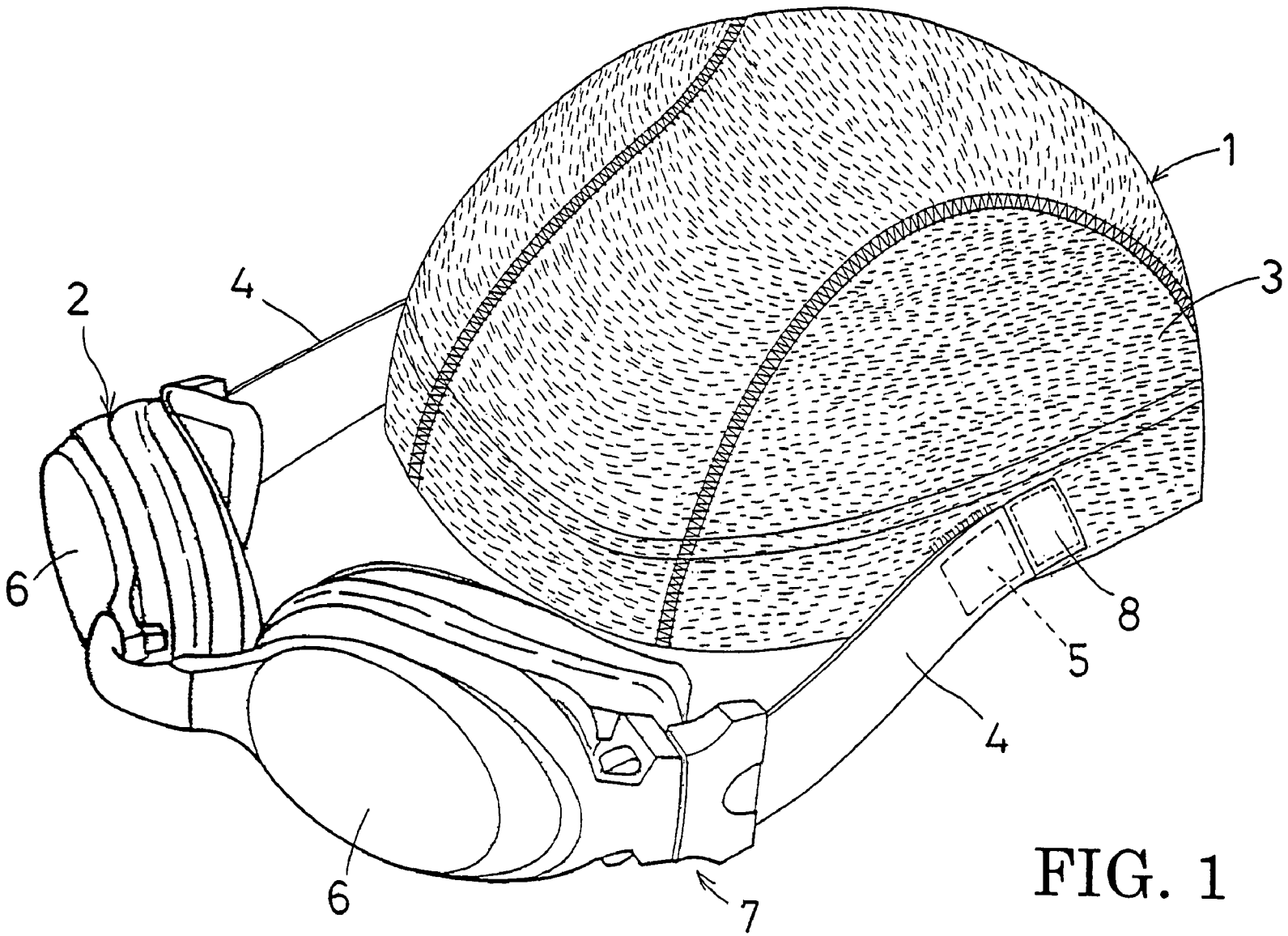
FIG. 1 is a perspective view showing an embodiment of a headcover and a goggle according to the present invention.

With reference to the drawings, the preferred embodiments of the headgear of the present invention will be described below.

The goggle also having a goggle frame, a face engaging means provided on a faceside of a goggle frame, and a pair of lenses provided in the goggle frame. The goggle frame also having a goggle skirt.

In FIGS. 1 to 4, a reference numeral 1 denotes a headcover according to the present invention and a reference numeral 2 denotes a goggle according to the present invention.

The headcover according to the present invention is provided with a headcover attaching part 3 having many loops that is provided at the front side thereof and the goggle 2 can be attached to the headcover 1 by detachably fitting a goggle attaching part 5 having many hooks that is provided at the back side of the end portion of a belt 4 of the goggle 2 to the headcover attaching part 3.

The goggle according to the present invention is provided with the goggle attaching part 5 having many hooks that is provided at the back side of the end portion of a belt 4 and the goggle 2 can be attached to the headcover 1 by detachably fitting the attaching part 5 to the attaching part 3 having many loops that is provided at the front side of the headcover 1.

In the meantime, it is preferable that the attaching part 3 has many loops and the attaching part 5 has many hooks because the front side of the headcover 1 feels pleasant to the touch, however, according to needs to the contrary, the attaching part 3 may have many hooks and the attaching part 5 may have many loops.

The headgear according to the present invention can serve as a headcover with a goggle when using it with the goggle according to the present invention. The goggle according to the present invention can serve as a goggle with a headcover when using it with the headcover according to the present invention. In other words, by providing the attaching part 3 having many loops to the headcover 1 at the front side thereof and providing the attaching part 5 having many hooks to the goggle 2 at the back side of the end portion of belt 4, by detachably attaching the attaching part 3 of the headcover 1 to the attaching part 5 of the belt 4, the goggle 2 can be attached to the headcover 1, and it becomes possible to provide the headcover with the goggle or the goggle with the headcover.

The headcover 1 may be formed in a shape covering the entire head like a cap, or may be formed in a shape covering the temporal region of the head like a hair band. Moreover, the headcover 1 may take any shape if the entire head or the temporal region of the head can be covered. In addition, the headcover 1 is manufactured by a stretchable clothing fabric or the like.

Figure 5:
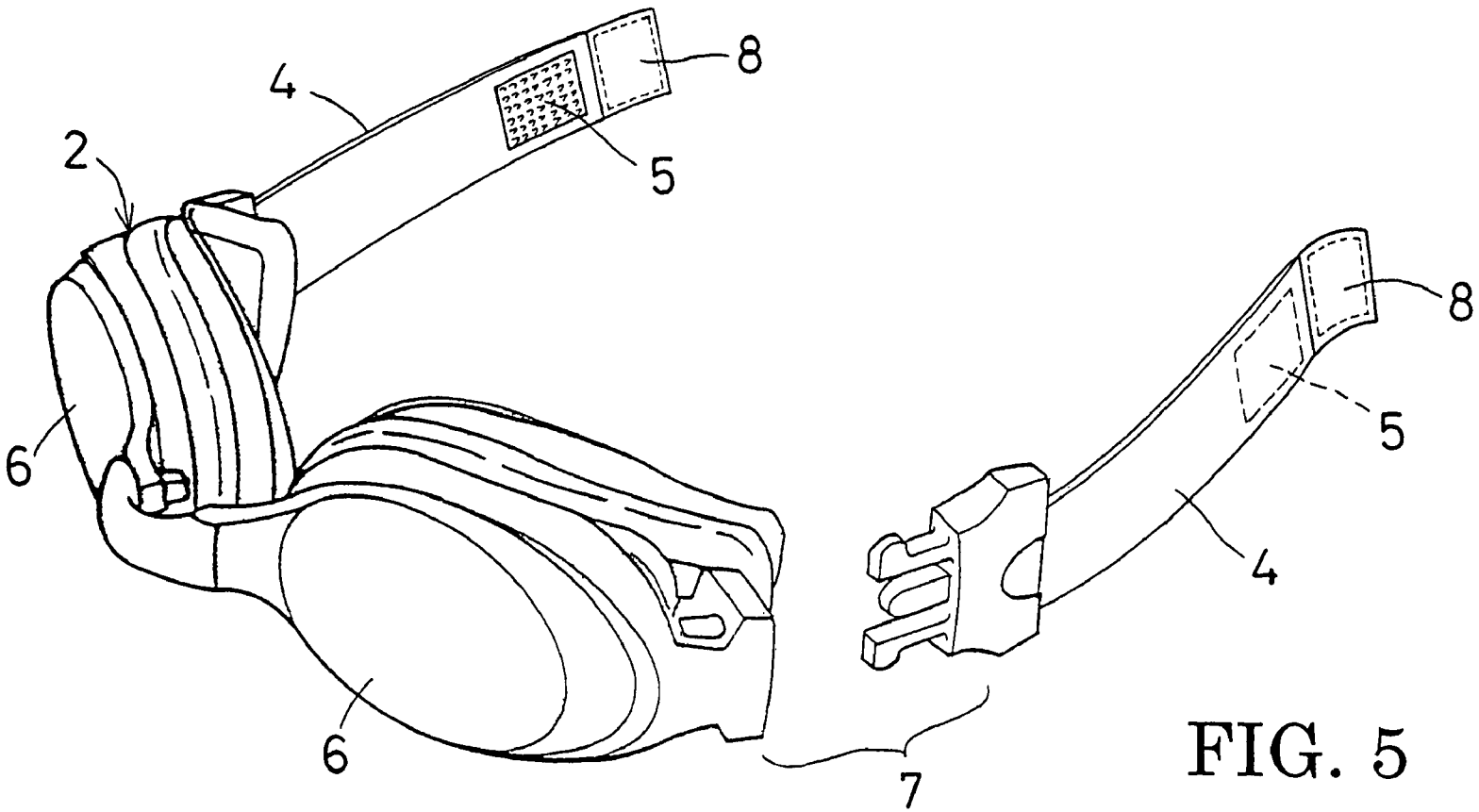
FIG. 5 is a partially exploded perspective view showing the goggle according to the present invention.

In the goggle 2, the belt 4 is attached to the right and left sides of a lens 6. The lens 6 of this goggle 2 shown in the drawings is a two-lens goggle, however, it may be a single-lens goggle. In addition, the lens 6 and the belt 4 may be connected undetachably, or detachably, as shown in the FIG. 5, by using a buckle mechanism 7 having a first buckle portion and a second buckle portion configured by a convex joint and a concave joint. As the goggle 2, sports goggle such as ski goggles, snowboard goggles and baseball goggles may be used, besides swimming goggles. Safety goggles such as welding goggles and protective goggles such as dust proof goggles and pollen proof goggles may also be used as the goggles 2. In addition, a glass-type eyewear such as sunglasses may be used as the goggle 2 instead of the goggle-type.

Figure 2:
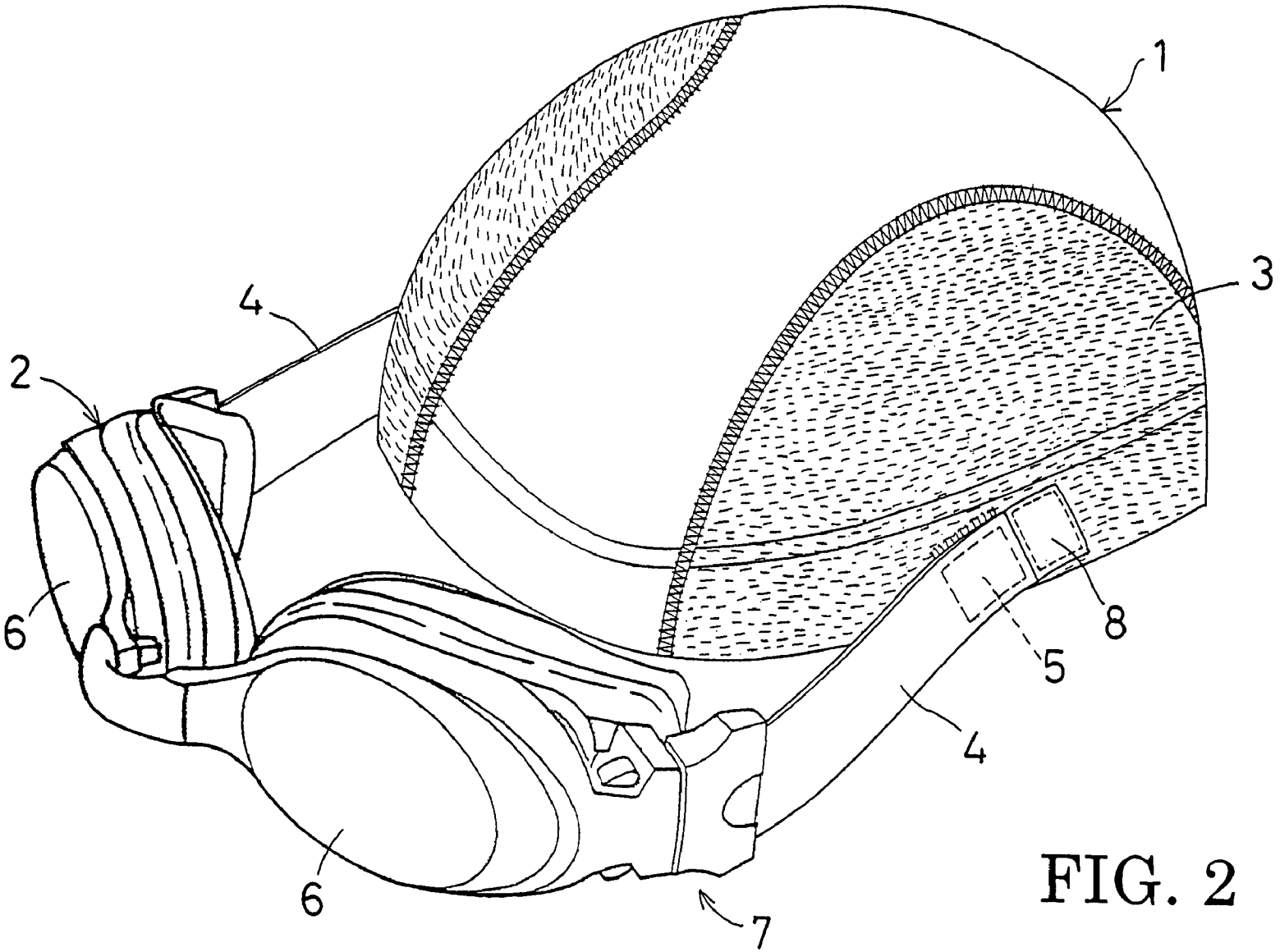
FIG. 2 is a perspective view showing another embodiment of the headcover and the goggle according to the present invention.
Figure 3:
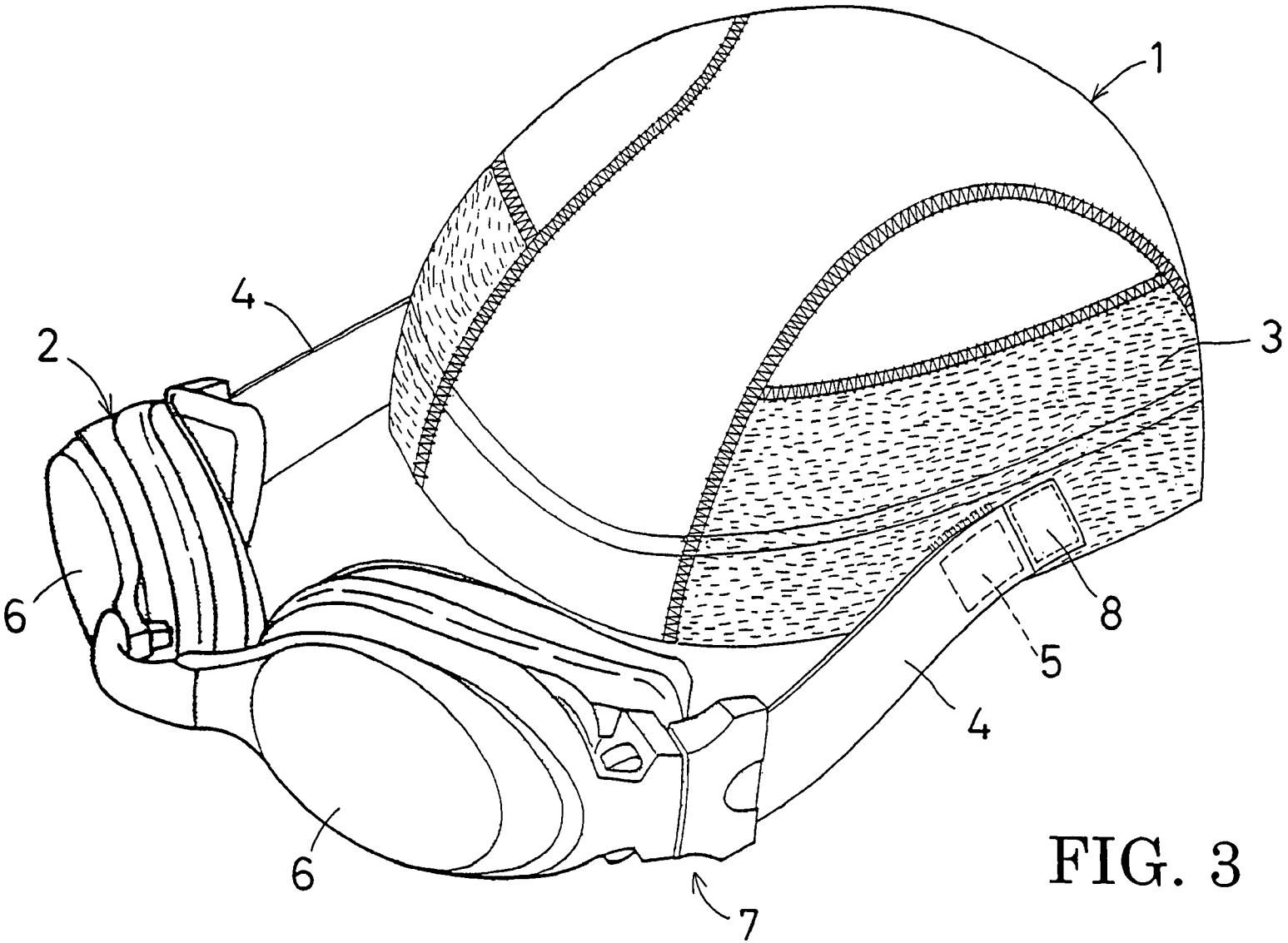
FIG. 3 is a perspective view showing yet another embodiment of the headcover and the goggle according to the present invention.
Figure 4:
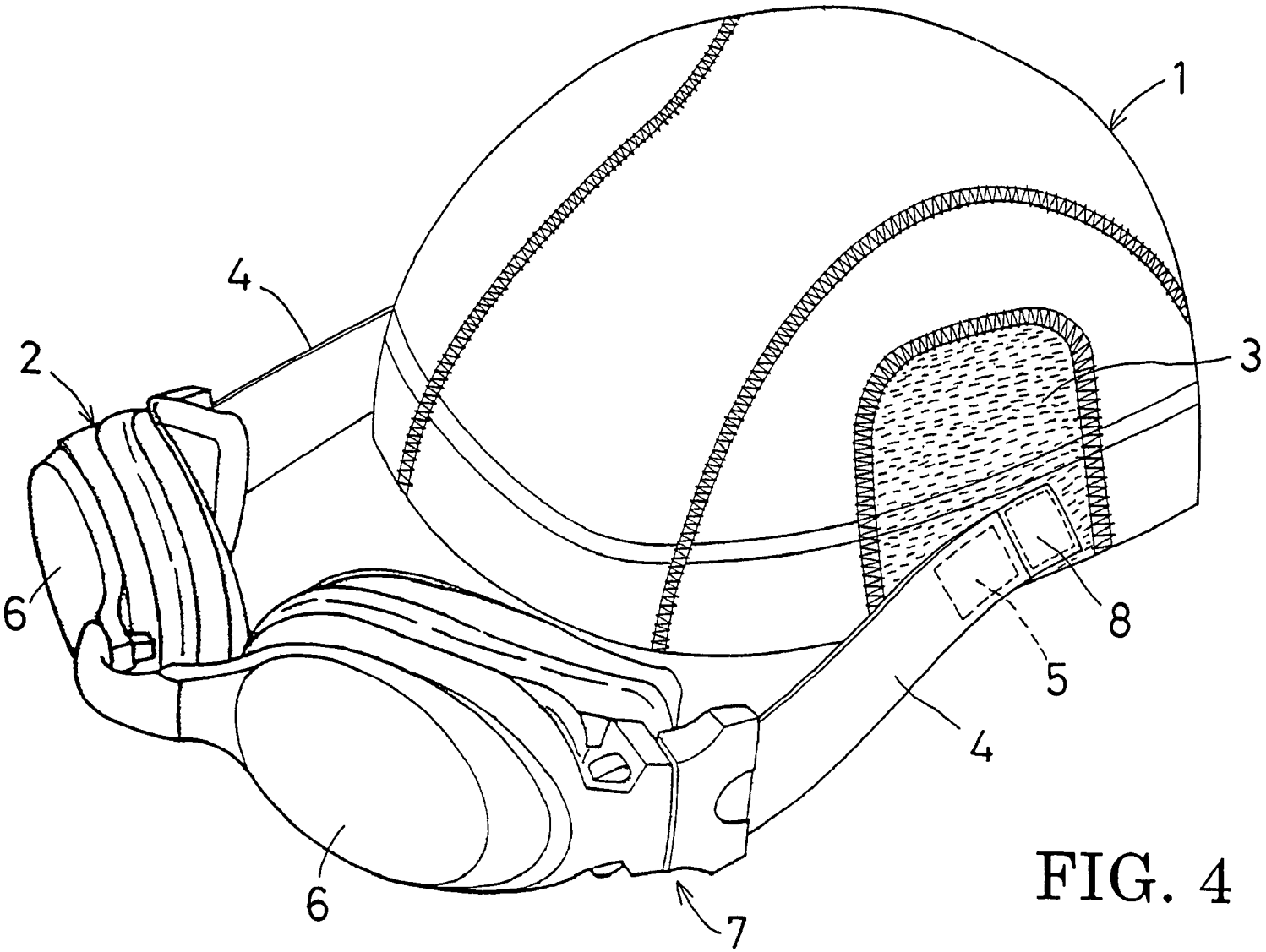
FIG. 4 is a perspective view showing still yet another embodiment of the headcover and the goggle according to the present invention.

The headcover attaching part 3 is manufactured, for example, by sewing a knit fabric having many loops on the front side of the headcover 1 or pasting the knit fabric thereon. This attaching part 3 may be provided on the whole part of the front side of the headcover 1 as shown in FIG. 1. The attaching part 3 may be provided only on the both sides at the front sides of the headcover 1 as shown in FIG. 2. Further, the attaching part 3 may be provided on the approximate lower half portions of the both sides at the front sides of the headcover 1 as shown in FIG. 3. Moreover, as shown in FIG. 4, the attaching part 3 may be provided on the approximate center portions of the approximate lower half portions of the both sides at the front sides of the headcover 1. In the meantime, in the case shown in FIG. 4, it is preferable that the attaching part 3 of the headcover 1 has an occupied area of 25% and more of the superficial area of the user's head so that the attaching position with the attaching part 5 of the belt 4 can be freely changed. In this way, regardless of the size of the user's head and the shape of the user's face, the attaching part 3 of the headcover 1 can be easily attached and detached to and from the attaching part 5 of the belt 4 and the holding force of the headcover 1 and the goggle 2 can be easily associated with the user's desired strength and fit.

The belt 4 is made from a stretch clothing fabric or the like and a finger grip portion 8 is attached to the far end portion of the end portion on which the attaching part 5 is disposed. In the meantime, this finger grip portion 8 may be made of a stretch clothing fabric, however, a no-stretch clothing fabric is more preferable because the gripping operation is easier.

The attaching part 5 is manufactured, for example, by sewing a fastener fabric sheet having many hooks on the back side of the end portion of the belt 4 or pasting the fastener fabric sheet thereon. Further, it is assumed that the attaching part 5 has an enough contact area that can secure the strength to maintain the connection between the goggle 2 and the headcover 1 when connecting this attaching part 5 to the attaching part 3 of the headcover 1.

The headcover and the goggle according to the present invention that are configured as described above are used together as follows.

Figure 6:
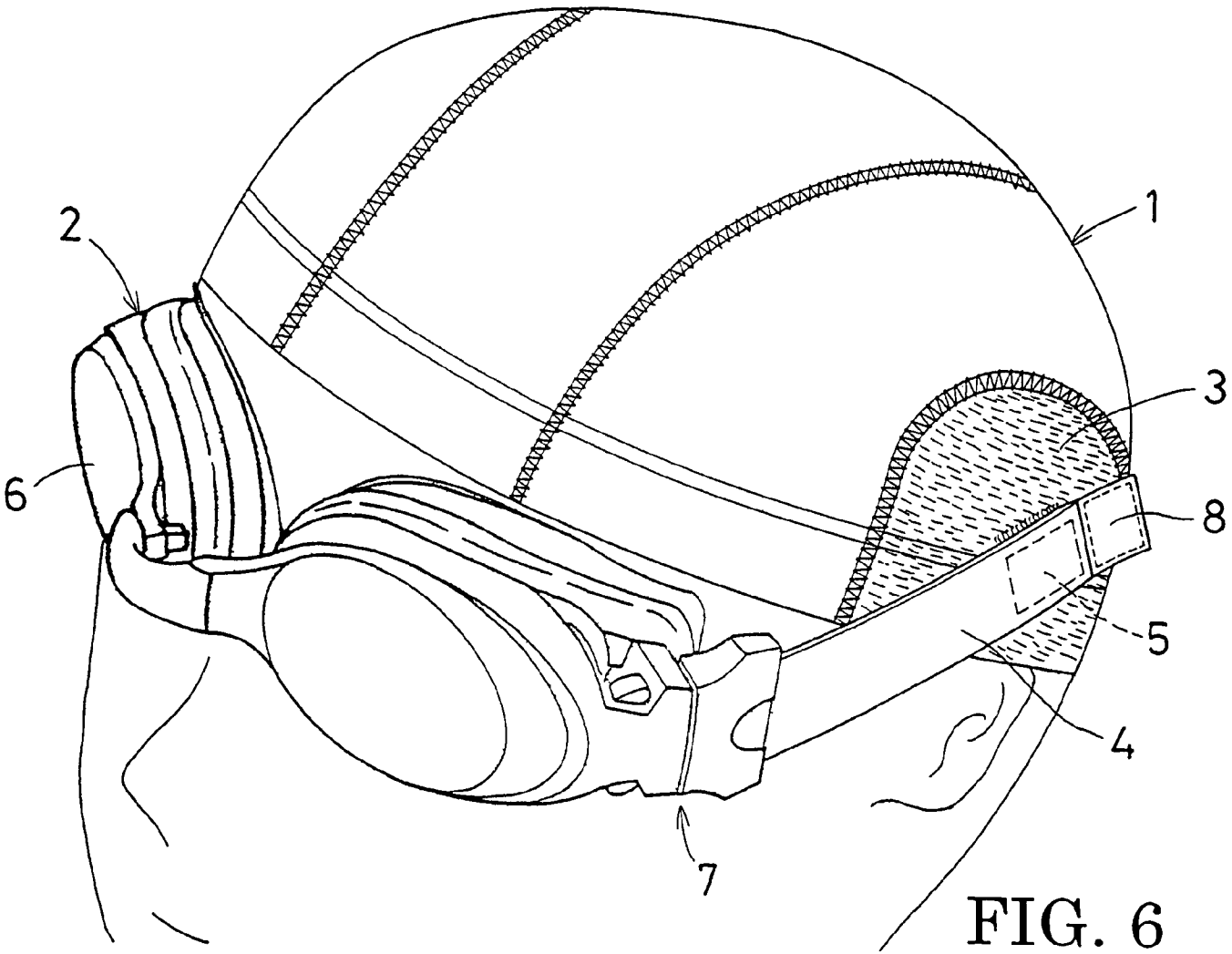
FIG. 6 is a perspective view showing the goggle and the headcover according to the present invention in use.
Figure 7:
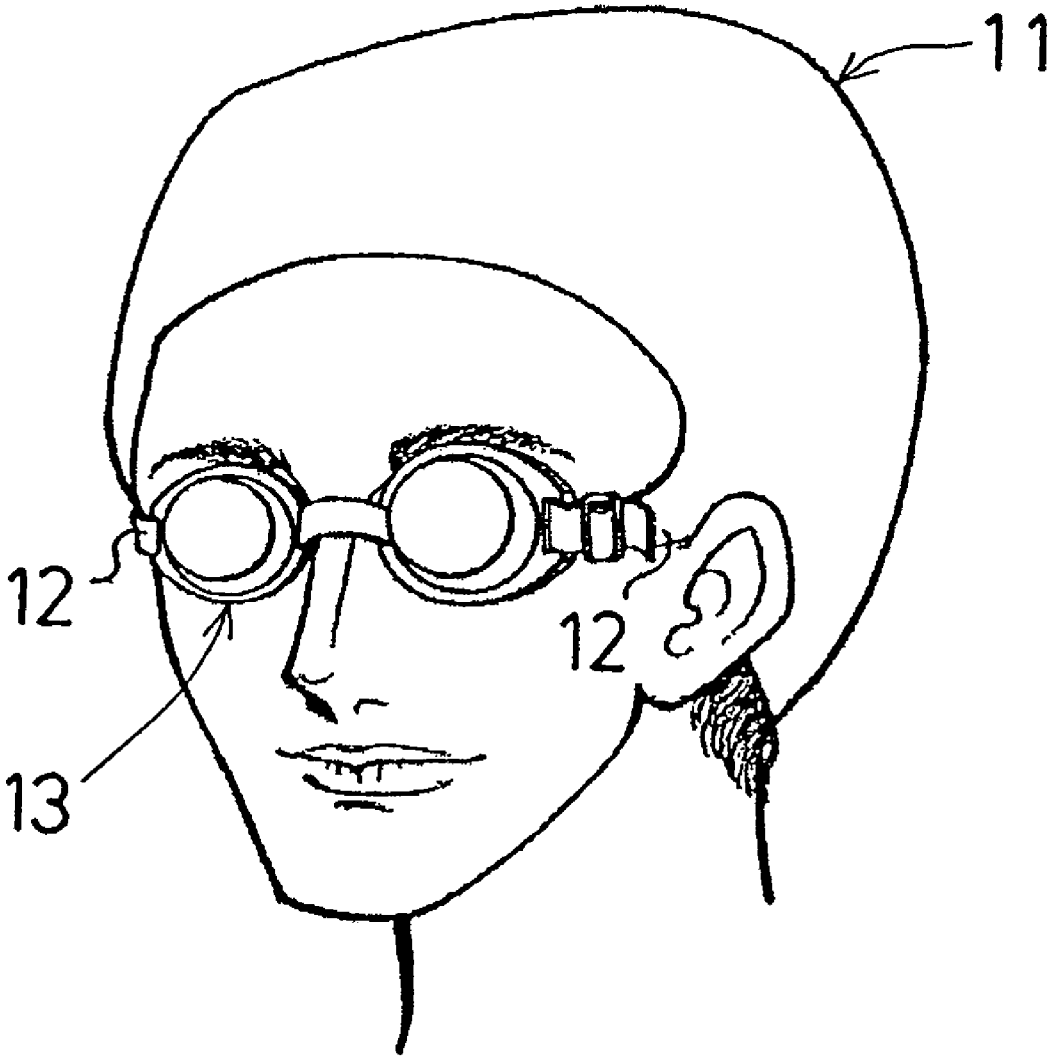
FIG. 7 Related Art
FIG. 7 is a perspective view showing a conventional swimming cap with a water glass in use.
Figure 8:
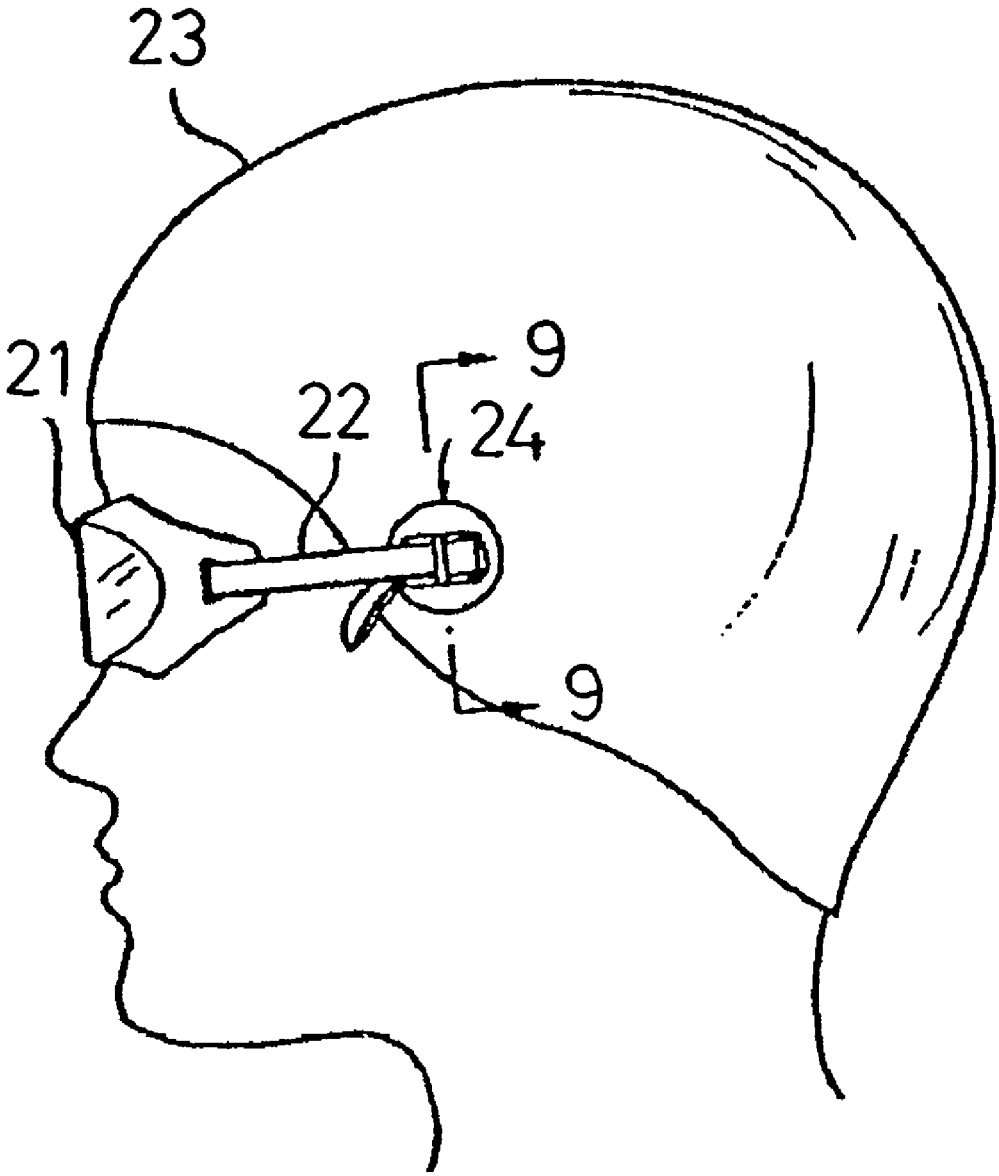
FIG. 8 Related Art
FIG. 8 is a perspective view showing a conventional swimming cap with a goggle in use.
Figure 9:
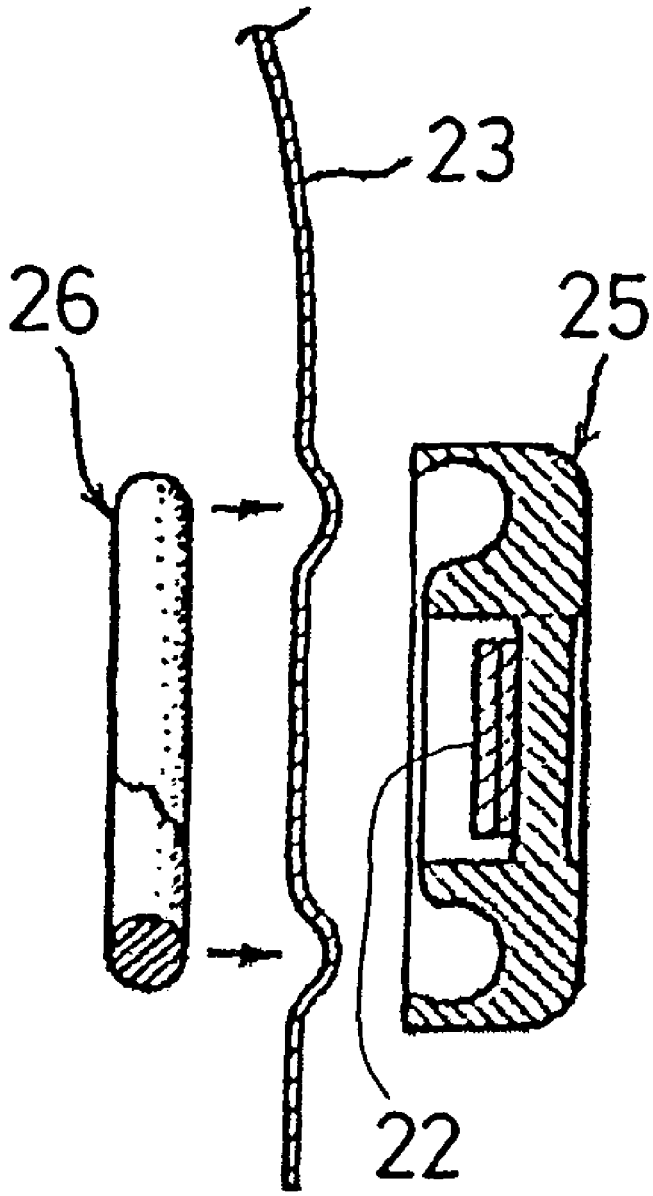
FIG. 9 Related Art
FIG. 9 is an exploded sectional view of the conventional swimming cap with the goggle taken on a line 9-9 in FIG. 8.

At first, the headcover 1 is fit to a regular position of the user's head. In the next place, putting the lens 6 of the goggle 2 on the user's face so as to cover the user's eyes, the finger grip portion 8 of the belt 4 is gripped by his or her fingers and the attaching part 5 is attached to the attaching part 3 of the headcover 1. Then, as shown in FIG. 6, the goggle 2 is attached to the headcover 1, and therefore the headcover and the goggle according to the present invention are fit to the head and the face of the user. In this case, the holding forces of the headcover 1 and the goggle 2 can be adjusted by the position where the attaching part 5 of the belt 4 is adhered in the attaching part 3 of the headcover 1 and the holding forces depend on the strength how strong the user stretches the belt 4.

Since the headcover 1 is made from the stretch clothing fabric, the headcover 1 can be easily fit to the user's head and it can be easily fit to the regular position. In addition, since the goggle 2 is also fit to the user's face after fitting the headcover 1 to the head, its fitting operation can be very easily carried out. Further, when fitting the headcover 1 to the head, even if the headcover 1 is deviated from the regular position, the position of the headcover 1 can be corrected to the regular position because of the flexibility of the headcover 1 and the belt 4. The stretch headcover 1 and the stretch belt 4 expand and contract each other while preventing the headcover 1 and the belt 4 from loosening and relaxing.

In the meantime, if the headcover 1 has no flexibility, it gets wrinkles along the head and the wrinkles increase water resistance or air is allowed to leak into the wrinkles to float the headcover 1, so that the belt 4 of the goggle 2 is forced to move and this may cause water leakage into the goggle 2. In addition, if the belt 4 has no flexibility, the goggle 2 is held only by flexibility of the headcover 1. Therefore, once the headcover 1 is overstretched to be a loose-fitting and the water resistance is increased due to the loose-fitting, this can be a cause of water leakage into the goggle 2 and a cause of dropping off of the headcover 1.

Then, according to the headgear of the present invention, since the goggle 2 is attached to the headcover by attaching the attaching part 5 of the belt 4 to the attaching part 3 of the headcover, the force of the belt to deviate the headcover 1 upward or forward does not apply to the headcover 1 although, in the conventional goggle, the force of the belt does apply to the headcover since the belt holds the entire circumference of the user's head. Therefore, the headcover 1 does not drop off from the head portion of the user. According to the headgear of the present invention, the downward force of the belt 4 to pull the headcover 1 downwardly so as to positively prevent the headcover 1 from dropping off.

In addition, in the goggle according to the present invention, since the user can adjust the holding force with respect to the headcover 1 by adjusting the position where the attaching part 5 of the belt 4 is attached in the attaching part 3 of the headcover 1 or the strength how strong the user stretches the belt 4, the length adjusting mechanism like the belt of the conventional goggle is unnecessary. Further, by adjusting the holding force with respect to the headcover 1 as described above, the holding force can be adjusted without detaching the goggle 2 from the face and the holding force can be easily adjusted. In case that the goggle 2 is a swimming goggle, the goggle of the present invention can prevent water leakage into the goggle 2. In addition, the person having a disability in his or her hand or the young children can easily fit the goggle according to the present invention to his or her head by himself or herself without the troublesome adjusting operation. In addition, when another person fits the goggle to the user's head, the troublesome adjusting operation is unnecessary, and since the excess force does not act on the neck of the user, the goggle can be easily fit to the head of the user.

What is claimed is:

1. A combination headgear comprising:

a headcover for covering a head of a wearer having left and right sides;

said headcover provided with a plurality of loop fasteners provided on said left and right sides of the headcover;

said headcover is made of a stretchable fabric allowing the headcover to create a form fit on the wearers head;

said headgear further comprising a pair of goggles which are removably attached to the headcover, said goggles having a goggle frame, a face engaging means provided on a faceside of said goggle frame and a pair of lenses provided in the goggle frame;

said face engaging means projects from said goggle frame in a direction of a face of said wearer and surrounds said lenses in said goggle frame, the face engaging means engages with a surface of a skin of said wearer and substantially surrounds each eye of said wearer, wherein the face engaging means are adapted to form an airtight seal around the eyes of the wearer and prevent water leakage in the goggle when worn;

said goggles further comprise a pair of belts that are detachably connected to said goggles, each belt of said pair of belts having a length extending from said goggle frame to said left and right sides of said headcover, said each belt of said pair of belts have two ends, one end of each belt is provided with a plurality of hook fasteners, said plurality of hook fasteners are adapted to removably attach with the plurality of loop fasteners on said headcover; a second end of each of said belts is directly coupled to the goggle frame via a buckle mechanism, wherein said buckle mechanism comprises a first buckle portion coupled to said second belt end and a second buckle portion coupled to said goggle frame, said buckle mechanism creating a releasable connection between said pair of belts and said goggles;

each belt of said pair of belts is located on a left and right side of the headcover respectively, said pair of belts are adapted to securely and removably attach said headcover and said goggles to one another to form said combination headgear.

2. The combination headgear according to claim 1, wherein the headcover and the pair of belts have flexibility.

3. The combination headgear according to claim 2, wherein the plurality of loops are provided on approximate center portions of approximate lower half portions of said left and right sides of the headcover.

4. The combination headgear according to claim 3, wherein a finger grip portion for detaching each of said belts from said headcover is provided to a far end portion of each of said pair of belts adjacent said plurality of hooks.

5. The combination headgear according to claim 2, wherein a finger grip portion for detaching each of said belts from said headcover is provided to a far end portion of each of said pair of belts adjacent said plurality of hooks.

6. The combination headgear according to claim 1 wherein the plurality of loops are provided on approximate center portions of approximate lower half portions of said left and right sides of the headcover.

7. The combination headgear according to claim 1, wherein a finger grip portion for detaching each of said belts from said headcover is provided to a far end portion of each of said pair of belts adjacent said plurality of hooks.

8. The combination headgear according to claim 6, wherein a finger grip portion for detaching each of said belts from said headcover is provided to a far end portion of each of said pair of belts adjacent said plurality of hooks.

9. The combination headgear according to claim 1, wherein, said loop fasteners having an occupied area of at least 25% of the area of the user's head covered by said headcover.

10. The combination head gear according to claim 1, wherein, said resilient face engaging means comprises a goggle skirt.

11. The combination head gear according to claim 1, wherein, said headcover comprises a swimming cap.

* * * * *